US007055185B1

(12) United States Patent
Deveer

(10) Patent No.: US 7,055,185 B1
(45) Date of Patent: Jun. 6, 2006

(54) ANTISEPTIC BIDET IN COMBINATION WITH A HYGIENE SAFETY GUARD

(76) Inventor: William B Deveer, 116-17 128th St., S. Ozone Pk, NY (US) 11420

( * ) Notice: Subject to any disclaimer, the term of this patent is extended or adjusted under 35 U.S.C. 154(b) by 0 days.

(21) Appl. No.: 11/028,112

(22) Filed: Jan. 3, 2005

(51) Int. Cl.
*E03D 9/08* (2006.01)

(52) U.S. Cl. ..... 4/420.4

(58) Field of Classification Search ..... 4/420.2, 4/420.4, 420.5
See application file for complete search history.

(56) References Cited

U.S. PATENT DOCUMENTS 4,903,347 A * 2/1990 Garcia et al. ..... 4/420.4
5,742,952 A * 4/1998 Huang ..... 4/420.4
5,839,129 A * 11/1998 Lee ..... 4/448
5,911,516 A * 6/1999 Chang ..... 4/420.2

* cited by examiner

*Primary Examiner*—Charles E. Phillips

(57) ABSTRACT

An effective hygiene device that enables easy installation to the toilet bowls of most households. It is comprised of a high pressure, adjustable water stream & an antiseptic spray. A built in Hygiene Safety Guard enables a safety margin against the male penis being in the toilet bowl. This invention easily installs onto toilet bowls found in most households. It also requires no connection to the water supply in the household. This invention may reduce infections that maybe afflicting children, adults, and the elderly, who may find toilet paper difficult to use. There are many serious diseases associated with human excrement, and the antiseptic spray feature of this invention may reduce the risk of many infections. This invention also leads to a higher quality of life and a greater feeling of cleanliness.

1 Claim, 5 Drawing Sheets

ANTISEPTIC BIDET IN COMBINATION WITH A HYGIENE SAFETY GUARD

CROSS-REFERENCES TO RELATED APPLICATIONS

Figure 1:
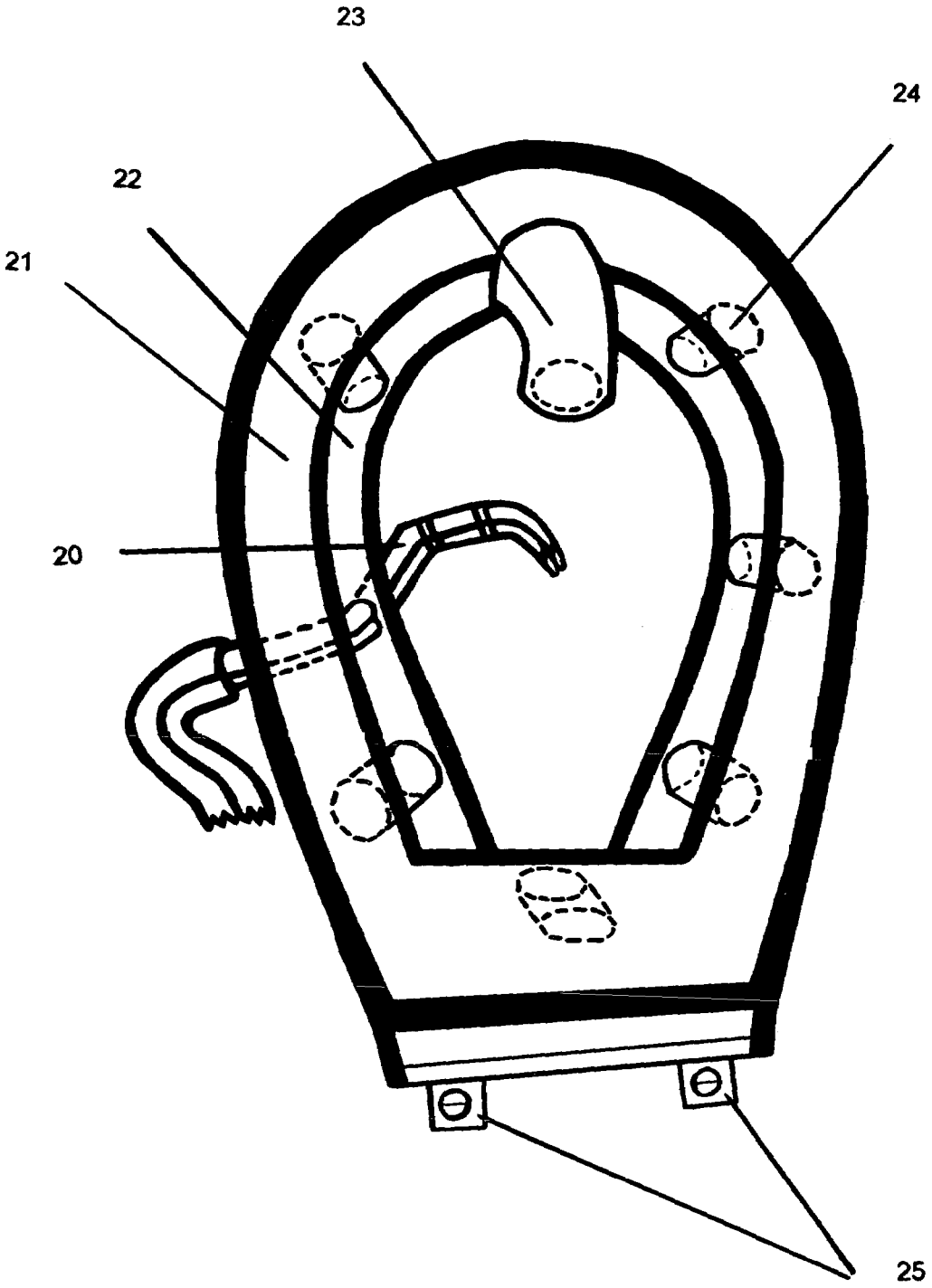

This invention is an improved version of this inventor's previous application (U.S. Pat. No. 5,722,097 to Deveer, 1998 Mar. 3.)

BACKGROUND

1. Field of Invention

This invention is in the field of sanitary products, specifically of bidets, to to cleanse a person's buttocks after defecation.

2. Discussion of Prior Art

The Antiseptic Bidet in combination with a Hygiene Safety Guard which has a turnable vertical spray bidet (which moves inside the toilet bowl), can be turned away while a person is in the process of defecating and moved back directly under the dirty buttocks after defecating. Prior art bidets did not allow for moving the bidet structure out of the way when a person was in the process of defecating (this was the disadvantage in U.S. Pat. No. 3,310,813 to Jonsson, 1967 Mar. 28.) If the bidet structure is not moved away when a person is defecating, then the bidet is soiled. This would lead to unsanitary conditions when the person is using the bidet after defecating. The water sprayed from the bidet would not be clean.

This takes away the sanitary aims of the use of a vertical spray bidet; this situation, in turn, may lead to serious disease. If the Jonsson bidet is placed on the toilet seat after the process of defecating, (and removed after the use of the bidet,) it be unsanitary; to remove an item, the structure of which had been in the toilet bowl. This may lead to serious disease when handling the bidet structure in and out of toilet bowl.

Other prior art mentioned in this inventor's previous application (U.S. Pat. No. 5,722,097 to Deveer, 1998 Mar. 3.) did not include a combination of a vertical spray with an antiseptic spray & a Hygiene Safety Guard. These prior art include the following U.S. Patents and their Inventors:

U.S. Pat. No. 1,520,892 Jan., 1924 Koppin
U.S. Pat. No. 4,069,519 Jan., 1978 Alexander
U.S. Pat. No. 4,998,300 Mar., 1991 Sharifzadeh
U.S. Pat. No. 5,359,736 Nov., 1994 Olivier
U.S. Pat. No. 5,504,948 Apr., 1996 Chandler
U.S. Pat. No. 5,566,402 Oct., 1996 Agha El-Rifai et al.

The above mentioned patents also do not include a separate, movable unit with water and antiseptic controls that can be placed in front of the person seated on the toilet seat. These controls enable easier adjustment of water pressure and antiseptic spray controls.

OBJECTS AND ADVANTAGES

The Antiseptic Bidet in combination with a Hygiene Safety Guard has many objects and advantages. These include a complete toilet seat and bidet structure which comes in one unit that replaces the existing seat. This enables easy installation of the invention onto an existing toilet seat. My invention also comes with a separate, movable unit with water & antiseptic controls that can be placed in front of a person seated on the toilet seat. This enables easier adjustment of the water, pressure, and antiseptic controls for greater comfort. The built in Hygiene Safety Guard enables the male penis to be kept safely away from the dirty water in the toilet bowl. The bidet structure and the toilet seat is enclosed within a splash guard that keeps any spray within the toilet bowl. The nozzle of the vertical spray tubing structure is crimped to create a high water pressure water stream that enables effective cleansing of the dirty buttocks. The pressure of this water stream is adjustable through the pressure adjustment knob. The second tube of the twin tubing structure sprays antiseptic.

This invention may reduce infections that may afflict children, adults, and the elderly, who may find toilet paper difficult to use. Toilet paper is not as effective as this invention. Human excrement has many serious diseases such as meningitis, certain types of hepatitis, and many other less serious infections. Some people maybe chronically infecting themselves due to improper toilet paper use.

This invention can quickly provide a higher state of hygiene that is easy to use against bacteria and virus that may lead to serious and/or minor infections. My invention is also easy to install in most households. It comes with screws that easily attach on to the existing toilet. It's as simple as replacing an old toilet seat with a new toilet seat. This invention also does not need a permanent connection to the existing water supply. It comes with a multi-groove funnel that can be placed under any size faucet. The funnel is placed temporarily under the faucet until the water tank is filled. The antiseptic container uses common antiseptic found in most drug stores and department stores. This is sold as yellow mouthwash and is inexpensive and available everywhere.

DESCRIPTIONS OF DRAWINGS

FIG. 1 shows the Bidet structure (20) and overall unit structure from an overhead view. The Hygiene Safety Guard (23) can be seen on top of the overhead view. The supports (24) that separate the lower section (22) from the upper section (21) can also be seen. The upper section (21) is comprised of the toilet seat of the of the overall unit structure. We can also see the easy installation screws (25) in FIG. 1.

Figure 2:
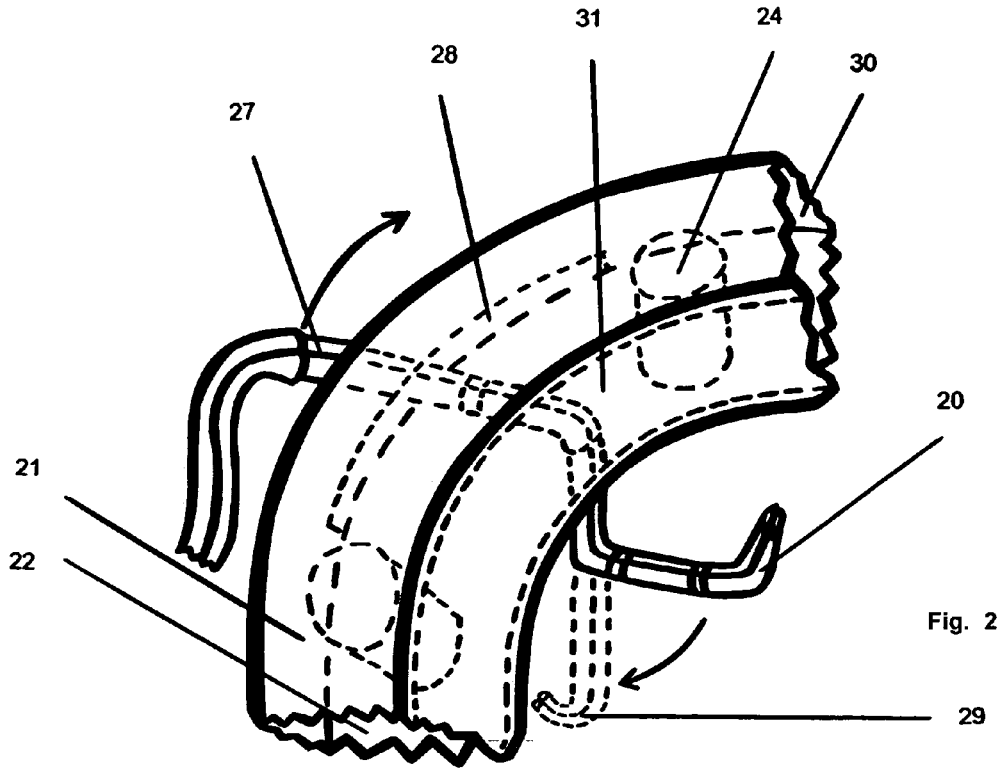

FIG. 2 shows the bidet tubing structure (20) and how it moves in an arc pattern to position (29) when handle (27) is moved forward in the direction of the arrow near handle (27.) FIG. 2 also shows the lower section (22) and and the upper section (21) which is the toilet seat.

The supports (24) that separate the lower section and the upper section can also be seen. FIG. 2 also shows the inner splash guard (31) and the outer splash guard (30.) The bidet handle moves back and forth through the narrow opening (28) which is in the outer splash guard (30.)

Figure 3:
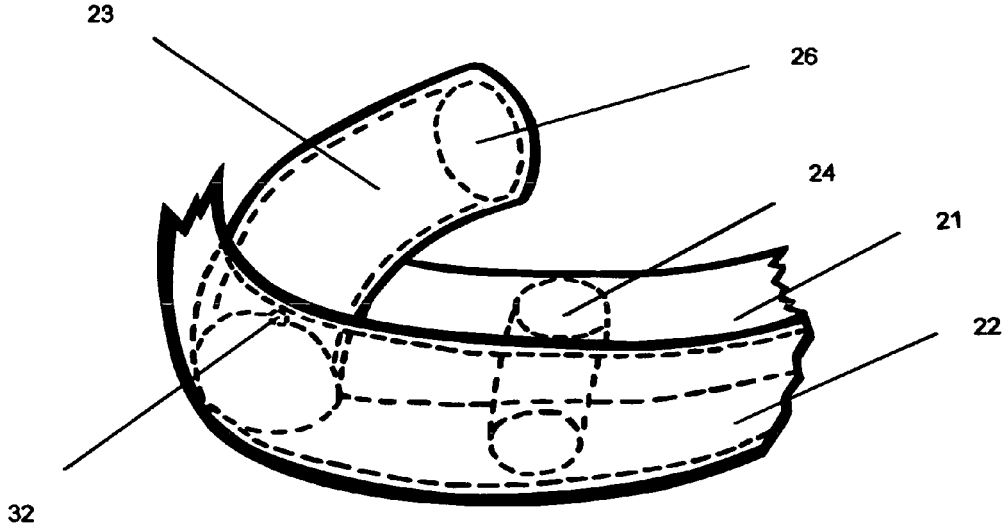

FIG. 3 shows another section of the overall unit structure. This shows the Hygiene Safety Guard (23) and the opening (26) where the male penis is inserted. This diagram also shows a small aperture (32) at the base of the Hygiene safety guard (23) that acts as a drain for urine to the toilet bowl below. FIG. 3 also shows the lower section (22) & upper section (21) and and the supports (24) of the overall bidet structure.

Figure 4:
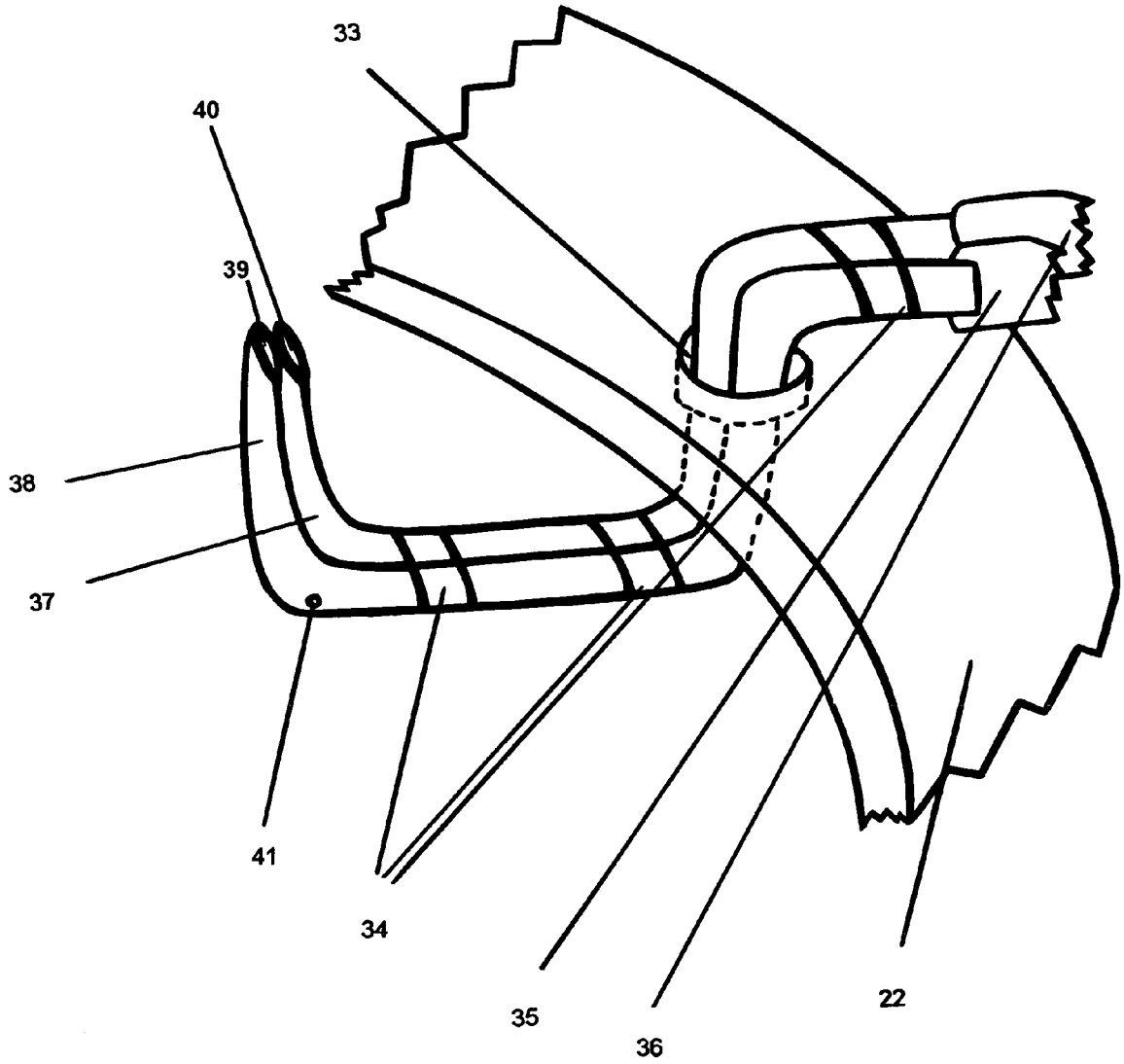

FIG. 4 shows a closer view of the bidet twin tubing structure. This diagram shows the tube that sprays water (38) and the other tube that sprays antiseptic (37). The crimped nozzles (39) & (40) can also be seen on both tubes. We can also see the drain aperture (41). FIG. 4 also shows the bindings (34). The twin tubes are also attached to the flexible tubes that carry antiseptic (36) and water (35). FIG. 4 also shows the round aperture (33) which acts as a pivot for the bidet structure. This round aperture (33) is present in the lower section (22) of the overall bidet structure.

Figure 5:
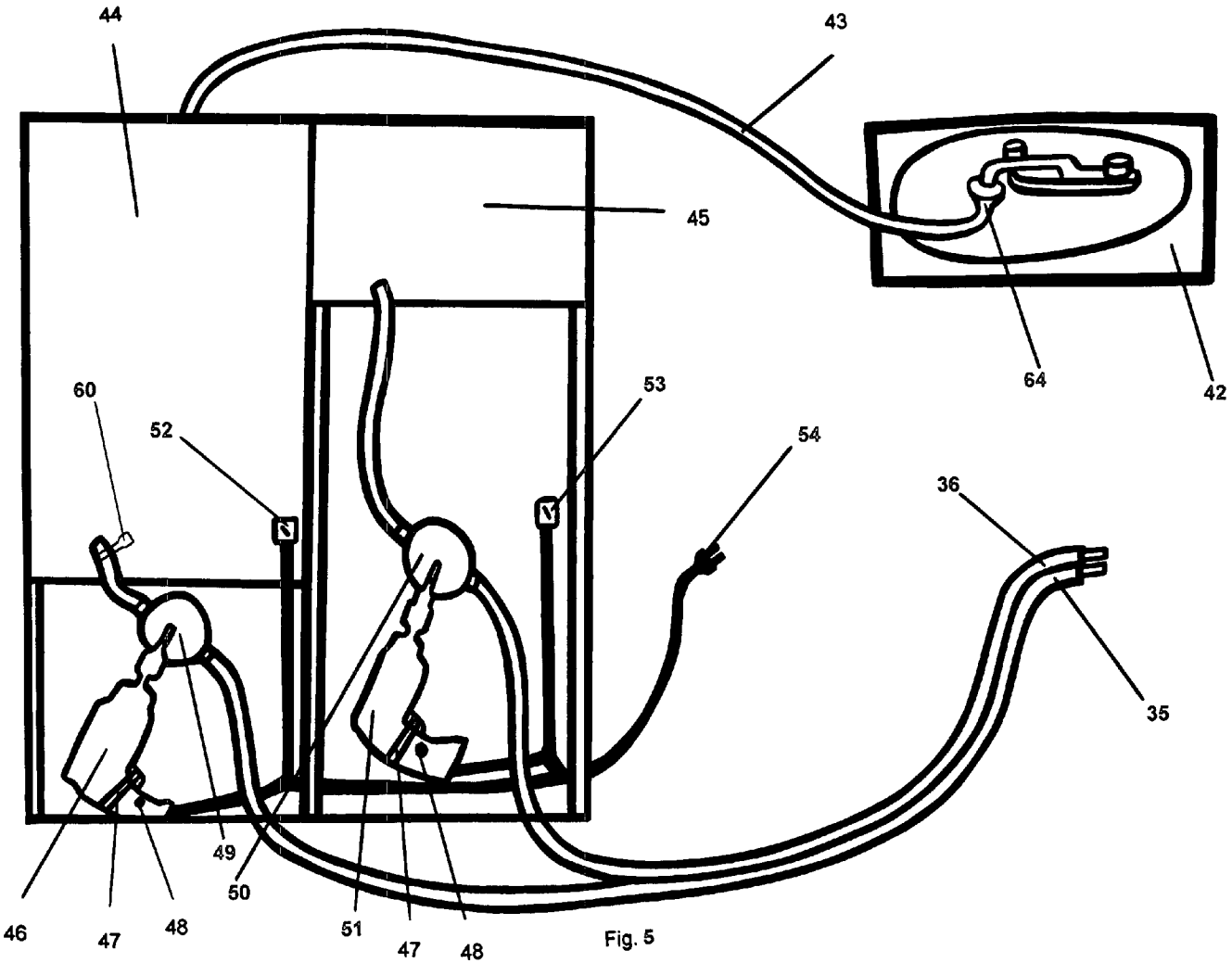

FIG. 5 shows the containers that store water & antiseptic, and the motor-pump system. The faucet & sink is shown by (42). The funnel (64) is shown placed under the faucet. The funnel is connected to a flexible tube (43) that is shown connected to water tank (44). The smaller antiseptic container (45) is also shown in FIG. 4. FIG. 4 also shows a flexible tube leading from the water & antiseptic tanks to the round pumps (49) & (50) that are, in turn, connected to drills (46) & (51). We can also see the pressure adjust valve (60) connected to flexible tube (35). The bindings (47) on the drill controls and the permanent-on button on the drills (48) can also be seen. The drills are connected by wire to on/off switches (52) & (53). The wire is then connected to a common electric plug (54). The pumps are then connected to flexible tubes (35) & (36) that are in turn connected to the rigid twin tubing structure of the bidet.

Figure 6:
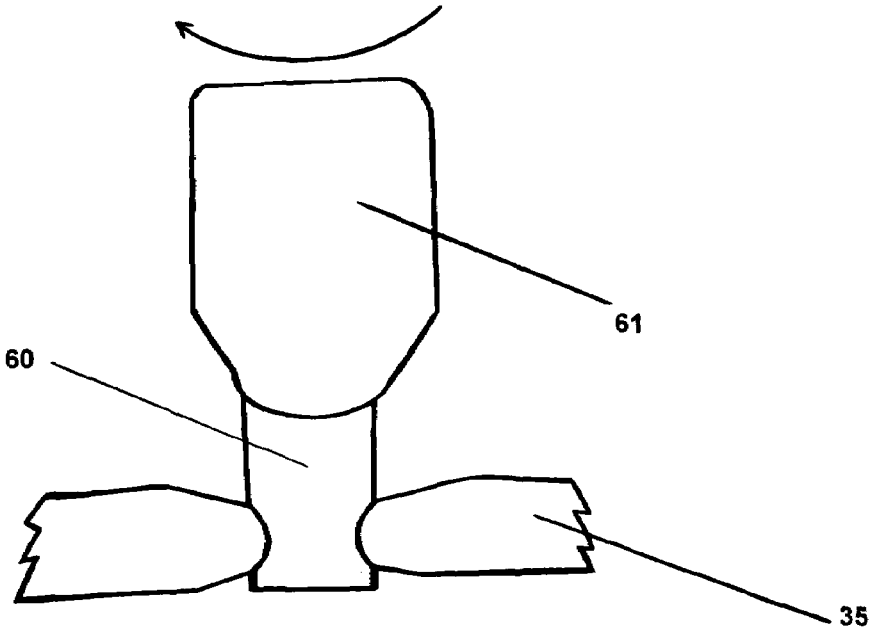

FIG. 6 shows the Flow Control Valve (60) The valve knob (61) can also be seen. The flexible water delivering tube (35) can be seen placed through the Flow Control Valve. This valve is sold by U.S. Plastic Corp., of Lima, Ohio.

Figure 7:
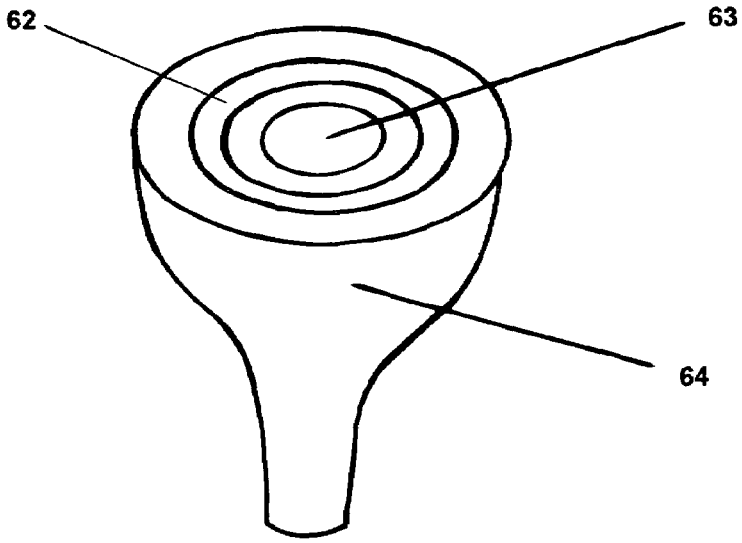

FIG. 7 shows the Multi-groove Funnel (64). We can see the closed section on top of the funnel showing the circular grooves (62) within this section. We can also see the aperture in the center of the funnel (63). This funnel is sold by The Blitz Co., of Miami, Fla.

LIST OF REFERENCE NUMERALS

20 The rigid bidet tubing structure
21 The upper section and toilet seat of the overall unit structure
22 The lower section of the overall unit structure
23 The Hygiene Safety Guard
24 The supports that separate the lower section from the upper section of the overall unit structure
25 The attachment screws that connect the bidet structure to the toilet bowl
26 The round opening in the Hygiene Safety Guard, where the male penis is inserted
27 The handle of the bidet rigid tubing structure
28 The long narrow opening in the outer splash guard
29 The position where the bidet nozzle moves to when handle is moved forward
30 The outer splash guard
31 The inner splash guard
32 The small aperture in the base of the Hygiene Safety Guard
33 The round bidet tubing pivot aperture in the lower section of the overall bidet structure
34 The bindings that bind the twin tubes of the bidet rigid tubing structure into one unit
35 The flexible tube that delivers water to the rigid tubing structure
36 The flexible tube that delivers antiseptic to the rigid tubing structure
37 The tube that sprays antiseptic
38 The tube that sprays water
39 The crimped spray nozzle that streams water
40 The crimped spray nozzle that streams antiseptic
41 The drain aperture in the base of the water delivery rigid tube
42 The sink & faucet found in most bathrooms
43 The flexible tube that is connected to the funnel
44 The water container
45 The antiseptic container
46 The electric drill used as the motor to turn the pump for pumping water
47 The bindings around the on button for the drills
48 The permanent-on button found on electric drills
49 The round drill pump used for pumping water
50 The round drill pump used for pumping antiseptic
51 The electric drill used as the motor to turn the pump for pumping antiseptic
52 The on/off switch to control the electric motor inside the water pumping drill
53 The on/off switch to control the electric motor inside the antiseptic pumping drill
54 The electric plug to connect the drill-motors to the electric outlet
60 The Flow Control valve that lowers the water pressure
61 The knob of the Flow Control valve that controls the water pressure
62 The closed top section that contains the multi-grooves of funnel (64)
63 The aperture in the center of funnel (64) that allows water to flow through
64 The multi-groove funnel

SUMMARY

In summary, my invention enables effective cleansing of the dirty buttocks after defecating. It includes a high pressure-adjustable water spraying nozzle and a second nozzle that sprays antiseptic. It also has a hygiene safety guard that enables the male penis to be inserted, keeping it away from the dirty water in the toilet bowl. This invention is also easy to install & operate, since no connection to the existing water supply is required. It can also be easily installed onto an existing toilet bowl by unscrewing the existing toilet seat and screwing on the Antiseptic bidet onto the toilet bowl. The water & antiseptic controls are conveniently placed in a separate movable unit that can be placed in front of the person seated on the toilet seat.

DESCRIPTION OF THE INVENTION

The overall bidet structure as shown in FIG. 1 is comprised of an upper section (21) and a lower section (22). The upper section is comprised of the toilet seat and a hygiene safety guard (23). This hygiene safety guard is shown more clearly in FIG. 3. It's angled towards the person seated on toilet seat and has a round aperture (26) that serves as the opening of this hollow safety device. A small drain aperture (32) exists at the base of this hygiene safety device as shown in FIG. 3.

FIGS. 2 & 3 also show the upper section affixed to, and supported & separated, from the lower section by the use of supports (24). The lower section (22) forms the base of the overall unit structure. The lower section contains the round aperture (33) as shown in FIG. 4. The twin rigid tubing structure (20) is then bent through the round aperture (33) to form a pivot apparatus.

The lower section also has the toilet bowl connecting screws (25). The lower and the upper sections are basically 2 toilet seats held together by supports (24). The inside edges of the upper & lower sections are enclosed by the inside splash guard (31). The outside edges of the upper & lower sections are enclosed by the outside splash guard (30) enclosed completely on their inside edges, along the contours of the toilet seat forms of said upper and lower sections, by a length of flat, flexible, material whose height is equal to the vertical height between the upper and lower sections, enabling an effective means to contain any extraneous spray that may occur during bidet operation, and said upper and lower sections are also enclosed on their outer edges with another flat, flexible material, whose height is equal to the vertical height between the upper and lower sections and whose shape follows the contours of the outer toilet seat shape of the upper and lower sections, which enables a means for an outer splash guard, and there also exists a long narrow opening on same outer splash guard, that enables a means for the hollow handle of said rigid twin tubing structure, to move back and forth, and. The water source is connected to the hollow handle (27) via flexible tubing (35), which in turn, is connected to the water delivering tube (38). The hollow handle (27) is comprised of the twin tubes that deliver water (38) and the other tube that delivers antiseptic (37). This twin-tubing rigid bidet structure can be seen in FIG. 4. FIG. 4 also shows the bindings (34) that form a single rigid unit structure out of two separate rigid tubes.

The flexible water carrying tube (35) also has a pressure adjust valve (60) shown in FIG. 5 & FIG. 6. The water delivering tube (38) of the rigid twin tubing structure of the bidet is bent ninety degrees upward and its tip is crimped into a high pressure nozzle (39). The base of the nozzle contains a small drain aperture (41). The tubing of the bidet structure has a long horizontal section equal to the radius of the average toilet bowl and then it's again bent ninety degrees upward to create a "U" shaped form. The tubing is then placed through the pivot aperture (33), and then horizontally bent ninety degrees into a length greater than the width of the upper & lower sections and approximately two inches beyond the outer edge of the lower section. This horizontal section then passes through a narrow & long opening (28) which exists on the outer splash guard (30). The two inches of tubing extending beyond the outer edge of the lower section is represented by handle (27) as shown in FIG. 2.

The invention also includes a water container (44) & antiseptic container (45) which are housed in a separate, movable unit. This unit shown in FIG. 5, includes the electric motor drills (46) & (51) which are connected the round liquid pumps (49) & (50). The electric motor drills are plugged into the electric outlet via an electric cord and via electric plug (54). The electric cords are routed through on/off switches (52) & (53). The round liquid pumps are connected to water container (44) & antiseptic container (45) via another section of flexible tubes (36) & (35) as shown in FIG. 5. The water tube (35) that connects the water round pump to the water tank (44) is placed through the pressure adjust valve (60) as shown in FIG. 5 & FIG. 6. FIG. 6 shows the knob (61) that is part of the pressure adjust valve (60). The output of the round water pump (49) is connected to flexible water delivery tube (35), which in turn is connected to the rigid water streaming tube (38) of the rigid twin tubing structure of the bidet. The output of the antiseptic pump (50) is connected to the flexible antiseptic delivery tube (36), which in turn, is connected to the rigid antiseptic spraying tube (37) of the rigid twin tubing structure of the bidet.

FIG. 5 also shows a sink & faucet (42), and, we can also see the funnel (64) placed under the faucet. The funnel (64) is connected to flexible tube (43), which in turn, is connected to water tank (44). The funnel (64) has an enclosed top with several circular grooves (62) as shown in FIG. 7. There is also an aperture in the center of the funnel (63).

OPERATION OF INVENTION

The installation of the Antiseptic Bidet onto the existing toilet is simple and easy. An ordinary person simply unscrews the existing toilet seat and connects the Antiseptic Bidet to the toilet bowl using the screws (25). It's the same process as replacing an old toilet seat with a new one.

There is no connection necessary to the water supply in the household as well. The water tank (44) is filled by placing the funnel (64) under the faucet/sink (42) as shown in FIG. 4. The funnel (64) is connected to flexible tube (43) that is connected to water tank (44). The funnel has a closed top with many circular grooves (62) that enable the funnel to be placed under any faucet of any size. This is shown in the lower diagram in FIG. 5. The funnel has an aperture (63) in the center of the circular grooves that lets water through into the flexible tube (43). The funnel is placed temporarily under the faucet until the water tank (44) is filled. The user of the bidet can adjust the temperature of the water by the controls of the faucet. The water tank holds many gallons of water that is enough for the average person to cleanse himself/herself. The user of the bidet also has to fill the antiseptic container with antiseptic. The best antiseptic is the yellow mouthwash antiseptic sold in most drug stores and department stores. It was originally developed in England by the Listerine Co. to disinfect surgical instruments. It's an effective and gentle antiseptic on the skin. (The meaning of antiseptic is an anti-germ agent that is effective against bacteria and virus'.) This antiseptic is inexpensive and available almost everywhere in the United States.

The person who is seated on the toilet seat (21) shown in FIG. 1 would then insert the male penis into the hygiene safety guard (23). This keeps the penis away from any splash and/or contact with the dirty toilet bowl and the dirty water that may splash during the process of defecation. When the person urinates, the urine will go to the base of the Hygiene Safety Guard and drain out of the urine drain (32) and into the toilet bowl below. Before the process of defecation starts, the person would move the handle (27) forward in the direction of the arrow shown in the top diagram in FIG. 2. This moves the nozzles (39) & (40) shown in FIG. 3 of the twin tubes of the bidet tubing structure away from the center of toilet bowl (and away from the anus of person who is about to start the process of defecation.) By turning the handle (27) forward the entire twin-tubing bidet structure pivots through the aperture (33) located on the inside edge of the lower section as shown in FIG. 4 and places nozzles (39) & (40) into the position (29) as shown in FIG. 2. The handle also moves back & forth through the narrow opening (28) that is present on the outer splash guard (30). The bindings (34) bind both tubes together into a single rigid structure that pivots as one unit through aperture (33) shown in FIG. 4. The handle is formed out of only two inches of the twin rigid tubing structure. This enables the invention to be used in bathrooms which are very small, where the space around the toilet bowl is very limited.

After the person has completed the process of defecation, he/she moves the handle (27) backward, which in turn, pivots the twin-tubing structure & its twin nozzles (39) & (40) forward. The person stops moving handle forward until the handle is perpendicular to his/her seated position and to the toilet seat. This places the nozzles (39) & (40) directly under the anus of the person seated on the toilet seat. The person then turns switch (52) on. This sends electric current to the drill motor (46) shown in FIG. 5. Since the bindings (47) around the drill on/off switch and the permanent on buttons (48) are depressed, the drills turn on and off when switches (52) & (53) are turned on and off.

The drill motor turns the round drill pump (49), which delivers a pressurized stream of water to flexible tube (35). Flexible tube (35) is connected to the rigid tube (38) which is the water delivering tube of the twin tubes of the bidet's rigid tubing structure. The water streams out of the water delivery nozzle (39) and onto to the dirty buttocks. The drain aperture (41) enables draining of any water remaining (after use of the bidet), from the "U" shaped bidet rigid tubing structure. This creates a block against contamination of the water tank from any dirty water remaining in the water delivery tube (38). The drill motor & drill pump combination delivers an optimal pressure (at 25 psi) for effective cleansing of the dirty buttocks. However, this pressure can be lowered by turning the knob of the pressure adjust valve (61) clockwise as shown by the arrow in FIG. 6.

While the person is using the water stream to cleanse his/her dirty buttocks, the higher water pressure creates water spray & splash when the water stream comes into contact with the dirty buttocks. This extraneous spray & splash is contained effectively by the inside splash guard (31), which completely encircles and seals the inside edges of the upper section (21) and the lower section (22). This can be seen in FIG. 2. There is also an outer splash guard (30). This seals the outer edges of lower section (22) and the upper section (21).

After 3 to 5 minutes of cleansing with water, the user of the antiseptic bidet turns off the water stream by turning switch (52) to the off position. Then, the person would turn on the antiseptic stream, by turning on switch (53). This sends electric current to drill motor (51) which turns on pump (50). This is used for a short time only, between 1 to 2 minutes. After the buttocks are sprayed with antiseptic, the person would turn off the antiseptic spray by turning switch (53) to the off position.

The person may use some toilet paper to blot any excess antiseptic that may be dripping.

CONCLUSION, RAMIFICATIONS, AND SCOPE OF INVENTION

This invention enables the average consumer access to an effective hygiene device with advanced innovations such as a high pressure water stream bidet that is that is controllable with a separate, movable water control unit (that can be placed in front of the person seated on the lavatory seat.) The high pressure water stream is adjustable. The water and antiseptic controls are easily adjustable with the controls in front of the seated person on the toilet seat. This invention may also reduce risk of infection to male genitals due to the built in Hygiene Safety Guard. This feature is unavailable in any similar products elsewhere. The antiseptic spray may reduce infections that may be afflicting children, adults, and the elderly. Toilet paper may be difficult to use for many people. This invention also comes with easy to install connectors that simply replace the existing toilet seat. There are no connections required to the water supply as well. This makes this invention to be installed and used easily & quickly by the average person.

The invention claimed is:

1. Claim a rigid twin tubing antiseptic bidet with a combination of a hygiene safety guard and a separate water and antiseptic control unit comprising of:

(a) a bidet unit whose structure is made of an upper section, which is formed in the shape of a toilet seat, enabling means for the toilet seat of the invention, and a lower section, also shaped in the form of a toilet seat, is separated and attached to the upper section into one unit with vertical supports, and there exists attachment screws affixed to the lower section enabling a means to easily attach the invention to average toilet bowl, and, where in front of the toilet seat, above the upper section, there exists a hollow angled rigid tube that is perpendicular to the plane of the upper section, where the angled section of this tube faces the person seated on the toilet seat, where same angled tube is affixed to the lower section of the bidet structure, with the angled tube placed through the upper section via a large circular aperture, whose diameter is equal to the diameter of the angled tube, where said angled tube enables a means for the male penis to be inserted for hygiene safety by keeping this vital organ away from the dirty water in the toilet bowl, and, there also exists a small drainage aperture on the base of the hollow section, facing the toilet bowl, which enables a means for draining urine into the toilet bowl, and, in between same upper and lower sections, (b) there exists a twin hollow rigid tubing structure whose length extends slightly beyond the outer edges of the upper and lower sections, enabling means for a handle for the rigid twin tubing structure, where same twin tubing structure is bent downward through an aperture in the inside edge of the lower section, facing the toilet bowl, where same rigid twin tubing is then bent into a horizontal section whose length is equal to the radius of the toilet bowl, and, where same rigid twin tubing is again bent in a (c) in a vertical, upward section with two crimped nozzles at the end of same rigid twin tubing, where same rigid twin tubing structure is made into a single unit with bindings such as hose clamps, where same structure enables means for the rigid twin tubing to pivot through the aperture in the lower section when said handle is moved back and forth, and also this enables a means for the crimped nozzles to be placed directly under the dirty buttocks, where one nozzle delivers a high pressure water stream and the other nozzle sprays antiseptic, which enables a means for effective cleansing and disinfection, and same upper and lower sections are, (d) enclosed completely on their inside edges, along the contours of the toilet seat forms of said upper and lower sections, by a length of flat, flexible, material whose height is equal to the vertical height between the upper and lower sections, enabling an effective means to contain any extraneous spray that may occur during bidet operation, and said upper and lower sections are also enclosed on their outer edges with another flat, flexible material, whose height is equal to the vertical height between the upper and lower sections and whose shape follows the contours of the outer toilet seat shape of the upper and lower sections, which enables a means for an outer splash guard, and there also exists a long narrow opening on same outer splash guard, that enables a means for the hollow handle of said rigid twin tubing structure, to move back and forth, and, (e) same hollow handle, formed by same rigid twin tubing structure, is connected to twin flexible tubes that deliver water and antiseptic, where same twin flexible tubes are in turn, connected to twin pumps that are powered by twin electric motors inside twin hand drills, and same twin pumps are connected via another section of flexible tubing to a water tank and an antiseptic container, where, (f) the twin motor pumps are connected to a water delivery flexible tube and an antiseptic delivery flexible tube, and same electric motors inside electric drills are connected via an electric cord and routed to two separate on and off switches, and then plugged into an electric outlet with an electric plug which enables a means for delivery of a pressurized water stream and antiseptic spray easily controlled by on and off switches, and, on the flexible water delivery tube attached from the water pump to the water tank, there exists a pressure adjust valve that enables a means for lowering the water pressure, and same water tank, at it's top, is connected to another flexible tube, which is then connected to a multi-groove funnel that enables a means for using said funnel under a faucet of any size, where same funnel is temporarily placed under a faucet, enabling a means for filling the water tank from a faucet without a permanent connection to the household water supply, and where above mentioned apparatus is housed in a separate, movable unit, that can be placed in front of the seated person on the toilet seat, thus enabling a means of operating the water and antiseptic controls with ease of use and comfort.

* * * * *